US005603568A

United States Patent [19]

Mobley et al.

[11] Patent Number: 5,603,568

[45] Date of Patent: Feb. 18, 1997

[54] SLUDGE DISPOSITION SYSTEM

[75] Inventors: Joseph E. Mobley, Rowlett; William O. Brown, Cleburn, both of Tex.

[73] Assignee: Texas Industries, Inc., Dallas, Tex.

[21] Appl. No.: 601,300

[22] Filed: Feb. 16, 1996

[51] Int. Cl.[6] ..... B01F 15/02

[52] U.S. Cl. ..... 366/196; 366/293; 366/319

[58] Field of Search ..... 366/194, 186, 366/189, 190, 195, 196, 293, 294, 295, 296, 319, 320, 321, 325.1, 603

[56] References Cited

U.S. PATENT DOCUMENTS

| | | | |
|---|---|---|---|
| 4,123,226 | 10/1978 | Vanderveen | 366/319 |
| 4,361,100 | 11/1982 | Hinger | 110/238 |
| 4,509,860 | 4/1985 | Lasar | 366/296 |
| 4,756,626 | 7/1988 | Neier | 366/279 |
| 4,765,747 | 8/1988 | High | 366/293 |
| 5,005,495 | 4/1991 | Feitel | 110/344 |
| 5,143,310 | 9/1992 | Neier | 241/101.8 |
| 5,144,892 | 9/1992 | Tupek | 366/320 |
| 5,147,133 | 9/1992 | White | 366/296 |
| 5,289,640 | 3/1994 | McCabe | 34/29 |
| 5,340,213 | 8/1994 | Rumph | 366/196 |
| 5,385,402 | 1/1995 | Rumph | 366/196 |

*Primary Examiner*—Robert W. Jenkins
*Attorney, Agent, or Firm*—William D. Jackson; Harris, Tucker & Hardin, P. C.

[57] ABSTRACT

A system for transportation of sludge material comprising an elongated tank having an arcuate bottom portion extending longitudinally of the tank and having a withdrawal port located in the arcuate bottom portion of the tank. An elongated conveyor system is disposed in the tank and comprises inner and outer auger flights mounted in the tank an axle extending longitudinally of the tank. The auger flights transcend only a minor cross sectional area of the tank and are configured to have opposing pitch slopes. The outer auger flight provides a positive pitch angle in the direction of the withdrawal port to displace sludge material toward the withdrawal port. The compound conveyor system embodies inner and outer auger flights as described previously in which at least the outer auger flight is in the form of a ribbon which is spaced axially from the axle on which it is supported and is wrapped around the axle in a manner in which the inner diameter of the ribbon flight is spaced radially from the axle. The inner auger flight has an outer diameter which is less than the inner diameter of the outer ribbon flight in order to define with the inner diameter of the outer flight, an open annular clearance between the two auger flights.

41 Claims, 2 Drawing Sheets

SLUDGE DISPOSITION SYSTEM

FIELD OF THE INVENTION

The present invention relates to the disposition of sludge materials, typically characterized as mixtures of solid particulates in a liquid medium, in a manner in which the sludge material effectively conveyed with the solid particulates in suspension for withdrawal at a discharge port.

BACKGROUND OF THE INVENTION

Various systems are available for mixing particulate materials which can be conveyed to a suitable end point for disposal. For example, U.S. Pat. No. 4,756,626 to Neier discloses a portable "mixer" which can be used to transport and discharge materials broadly characterized as fluent and non-fluent materials. Such materials may include feedlot mixtures which are characterized as relative low density materials and fertilizer mixtures which are characterized as being of somewhat higher density, for example, about 60 lbs./cu.ft. The Neier system includes a pair of elongated side-mounted augers in an auxiliary chamber which are disposed along side a relatively large rotor mounted in a main chamber and having a plurality of elongated rotor bars attached to radial arms extending outwardly from the rotor axle. The two augers and the rotor, rotate about longitudinally extending axes which are parallel to one another. The two augers are provided with curved paddles at opposed ends near a discharge door. The paddles at the end of the upper auger function to move the material down to the lower auger or laterally into the main chamber and the paddles at the reverse end of the lower auger serve to move the materials outwardly through a discharge door or upwardly where they are contacted with the upper auger. In view of the high torque imposed upon the rotor blades, spring-loaded pivoting connections are employed to connect these blades to the radial arms extending outwardly from the axle of the rotor.

U.S. Pat. No. 5,005,495 to Feitel discloses a system for removing volatile organic materials from particulate materials characterized as "sludge" or soil. Such sludge materials are characterized as particulate materials such as soil containing hydrocarbons such as gasoline, fuel oil or kerosine and other such organic materials. The Feitel system incorporates an elongated housing having four forward parallel mounted augers whose flights partially overlap somewhat to provide good mixing and heating of the sludge material within the housing in which the augers are arranged. The augers or "screws" have hollow flights through which a heat exchange medium can be passed as the augers are rotated.

A somewhat similar situation involving the use of parallel mounted screw augers in the handling of waste materials such as sludges and contaminated soils is disclosed in U.S. Pat. No. 5,289,640 to McCabe. Here again, augers are characterized as screw conveyors are mounted in an elongated container for rotation about parallel axis with the auger flights slightly overlapping. As in the case of the systems described previously, the screw conveyors transcend a substantial cross sectional area within the housing in which they are disposed. A discharge port is located at one end of the housing and is equipped with an air lock through which the waste medium may be discharged.

U.S. Pat. No. 5,385,402 to Rumph discloses a system for holding and transporting hazardous waste materials in a manner to provide for thorough mixing of the solid and liquid components of these materials. The Rumph system comprises an elongated tank which can take the form of a tank trailer, truck, railcar or boat which is equipped with an agitation system extending along the length of the tank. The agitation system in Rumph is somewhat similar to the rotor configuration of the aforementioned patent to Neier in that a plurality of elongated blades mounted for rotation with a shaft extending longitudinally of the tank. Like the rotor of Neier, the Rumph agitator transcends a major cross-sectional area of the tank and occupies a substantial vertical dimension of the tank in which it is mounted. Because the elongated blades rotate throughout a substantial cross sectional area of the tank and necessarily incorporate high torque requirements into the system, in order to keep the weight as low as possible, the blades, supports and the radial arms upon which the blades are mounted are made of a relatively lightweight material such as aluminum. The rotary agitation systems in Rumph are driven by suitable internal motors such as hydraulic motors which are powered with hydraulic fluids supplied from an external hydraulic power unit.

SUMMARY OF THE INVENTION

In accordance with the present invention, there is provided a system for the transportation or other appropriate disposition of sludge material which allows for effective removal of such sludge material while leaving behind only small amounts of residue after the sludge material has been disposed of. In one embodiment of the invention, there is provided a system for transportation of sludge material comprising an elongated tank having an arcuate bottom portion extending longitudinally of the tank. The tank preferably is generally cylindrical, i.e. configured to be of a generally circular or elliptical cross section, having an arcuate bottom portion extending along the longitudinal dimension of the tank. The tank is suitably adapted to contain a sludge material comprising a mixture of solid particles in a liquid medium. A withdrawal port is located in the arcuate bottom portion of the tank to provide for withdrawal of sludge material from the tank. An elongated conveyor system is disposed in the lower half of the tank along the major axis thereof. The conveyor system comprises inner and outer auger flights mounted in the tank for concentric rotation about an axis extending longitudinally of the tank. The auger flights are configured to have opposing pitch slopes, i.e., the outer flight has a pitch slope with is pitched in an opposite direction with respect to the pitch slope of the inner auger flight. The outer auger flight transcends only a minor cross sectional area of the tank, preferably a cross sectional area of no more than about ⅕ of the average cross sectional area of the tank. Preferably, the inner and outer auger flights are concentrically supported on a common axle which extends longitudinally of the tank. The axle is rotated by a prime mover, normally located within the tank, in a rotational direction such that the outer auger flight provides a positive pitch angle in the direction of the withdrawal port. Thus the outer auger flight displaces sludge material in the tank in the direction of the withdrawal port. The inner auger flight is pitched, as noted above, in an opposed direction, thus tending to "pick up" material off the bottom of the tank and contain the particulate material in suspension within the liquid medium near the bottom of the tank.

In yet a further aspect of the invention, the conveyor system embodying the present invention further comprises a plurality of radially extending paddles which are disposed longitudinally along the axle at angularly displaced positions. The paddles have transverse active faces and are preferably pitched in the same direction as the outer auger flight. Preferably the paddles extend radially outwardly from the axle beyond the perimeter of the outer auger flight.

In yet a further embodiment of the invention, there is provided a transportation system such as a semi-trailer, tanker car or the like which comprises an elongated tank having an intermediate drop portion and first and second bottom portions sloping toward the intermediate drop portion. That is, the bottom portions slope downwardly in a converging relationship with the withdrawal port located in the drop portion of the tank. One section of the tank is provided with an elongated conveyor system disposed longitudinally in the tank near one bottom portion of the tank. The conveyor system comprises an inner auger flight and an outer auger flight disposed for concentric rotation about an axis extending longitudinally of the tank. Inner and outer auger flights are pitched in opposed directions as described above. A second similarly situated elongated conveyor system is disposed near the second bottom portion of the tank. Means are provided for rotating the auger flights of both conveyor systems such that the outer auger flights are disposed for movement in direction of the withdrawal port.

Another aspect of the invention embodies a compound conveyor system embodying inner and outer auger flights as described previously in which at least the outer auger flight is in the form of a ribbon. The ribbon flight is spaced axially from the axle on which it is supported and is wrapped around the axle in a manner in which the inner diameter of the ribbon flight is spaced radially from the axle. The inner auger flight preferably has an outer diameter which is less than the inner diameter of the outer ribbon flight in order to define with the inner diameter of the outer flight, an open annular clearance between the two auger flights. In this embodiment of the invention, the inner auger flight may be a solid screw type auger flight or it may be a ribbon type flight, preferably the latter.

DETAILED DESCRIPTION OF THE INVENTION

The present invention provides a system for the disposition of sludge material such as hazardous waste materials and the like in a manner in which the particulates in the sludge material are effectively maintained in suspension near the bottom of the tank and conveyed along the tank bottom for disposal through a withdrawal port. The invention will be described in detail with respect to a tank trailer of the type which may be used in conjunction with a semitrailer/tractor rig or the like, but it will be understood that the invention will find application of various other systems. For example, the present invention may be employed in railroad tank cars or in stationary tanks or transportable containers or other systems where it is desired to maintain particulate materials in suspension to allow their delivery to a suitable disposal zone such as a high temperature incinerator or the like.

The present invention provides for effective disposition of the particulate materials in suspension in a manner to leave very little residue behind in the container, while at the same time minimizing disruption of the liquid throughout the vertical cross section of the tank or other container except as will occur due to convection induced by agitation within only a relatively small lower portion of the tank compartment. Thus, the present invention presents a significant departure from the conventional view which dictates that the solid particulate materials should be kept in a more or less homogenous suspension in order to aid in discharging the solids from es of the medium. Consistent with this conventional view, the aforementioned patent to Rumph employs an elongated blade-type agitator which occupies a substantial vertical dimension of the tank in order to provide a thorough mixing of the solids and liquids. By maintaining this thorough mixing it is thought that not only complete discharge of solids is facilitated, but also a more homogenous fuel is arrived at.

This invention provides an alternative approach. Here, the emphasis is not on preventing the solids from settling toward the bottom of the tank in order to maintain a good dispersion throughout the tank volume, but on discharge of the solids along the bottom of the tank to the discharge port. Here, settling of solids to or near the bottom of the tank is accepted. It is necessary only to "pick up" the solids from or near the bottom surface and convey these solids to the discharge port.

Figure 1:
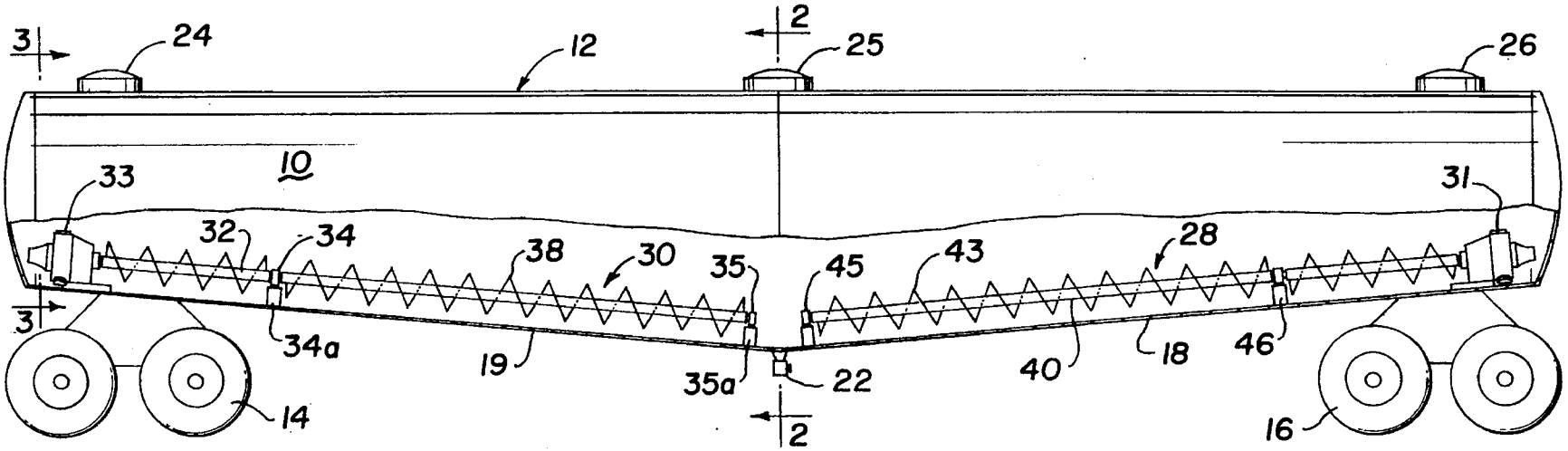
FIG. 1 is a side elevation, with parts broken away, of an elongated tanker embodying the present invention.

Turning now to the drawings and referring initially to FIG. 1, there is illustrated a tank 10 for use with a semi-tractor rig. The tank, which is shown schematically and with parts broken away to reveal the inner conveyor system, is incorporated in an elongated tank trailer 12 comprising fore and aft tandem wheel carriages 16 and 14. The tank 10 is generally cylindrical and is configured so that fore and aft arcuate bottom portions 18 and 19 slope downwardly to an intermediate drop portion 20 of the tank. A valved withdrawal port 22 is located in the intermediate drop portion 20 to permit the discharge of waste material from the interior of the tank. The tank 10 is provided with domed manhole hatches 24, 25 and 26 disposed longitudinally along the top of the tank. In the embodiment shown in FIG. 1, the tank 10 is provided with two conveyors 28 and 30 which are powered by separate prime movers 31 and 33, respectively, which can be individually activated to maintain the sludge within the tank 10 in a suitable suspension near the bottom of the tank while conveying particulates to the bottom discharge portion 2 of the tank 10.

As illustrated in FIG. 1, the aft conveyor system 30 comprises an axle shaft 32 which is mounted by bearings 34 and 35 supported on suitable bearing bases 34*a* and 35*a*. Positioned to the rear of the outer bearing base 34*a* is prime mover 33 for the axle shaft 32 which may be of any suitable form. For example, the prime mover 33 may take the form of a hydraulic motor such as disclosed in the aforementioned patent to Rumph. Such hydraulic motors are well known in the art and are desirable for use where possibly flammable sludge material is involved. Where a hydraulic motor is employed, an external power unit (not shown) can be used to feed hydraulic fluid through suitable high pressure lines (not shown) extending from the external unit through the wall of the tank. Prime mover 32, like prime mover 33, preferably is in the form of a hydraulic motor powered by an external power unit by means of high pressure hydraulic lines. to the prime mover 33 to drive the prime mover. By way of example, the domed manhole hatches 24 and 26 which provide access to the internal hydraulic motors can also be employed to extend high pressure lines from an external motor into the interior of the tank to the prime movers. Instead of internal prime movers as shown, it is to be recognized that the axles 32 and 40 can be driven by external prime movers mounted at the ends of the tank. That is, the axles may extend through suitable seals to external prime movers.

The conveyor system 30 of the present invention comprises a compound auger system 38 preferably comprising inner and outer auger flights as described in greater detail below with respect to FIG. 4. The inner and outer auger flights have opposed pitch slopes, This arrangement, preferably coupled with the use of intermittent radial paddles as described below, allows effective control of the sludge suspension near the bottom of the tank without the need for relatively large longitudinal blades, with their corresponding high torque requirements, such a disclosed in the aforementioned patent to Rumph. Within this region, the sludge within tank 10 is effectively maintained in the suspended form for ready withdrawal. The particles may settle out of the liquid to the region adjacent to the bottom of the tank.

Figure 3:
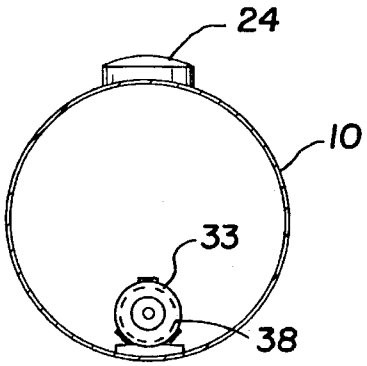
FIG. 3 is a sectional view taken along lines 3—3 showing details of the tanker near one end thereof.
Figure 2:
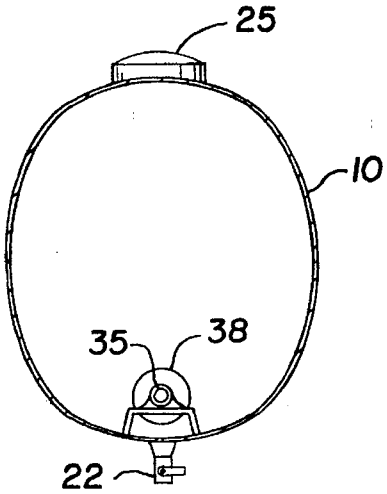
FIG. 2 is a sectional view taken along line 2—2 of FIG. 1 showing details of the interior of the tanker at the mid-section of the tanker.

FIGS. 2 and 3 are cross sectional views of the tank 10 taken along lines 2—2 and 3—3 respectively of FIG. 1. Due to the fact of the downwardly sloping bottom portion 19, the cross sectional area of the tank depicted in FIG. 2 is, of course, somewhat larger than a cross sectional area of the end portion of the tank is shown in FIG. 3. By way of example, for a tanker having a total length of about 40 feet the vertical dimension of the tank at the centerline cross sectional view of FIG. 2 would be about 6 ½ feet. The vertical dimension at the end cross sectional view as shown in FIG. 3 would be about 5 feet. Depending upon the configuration of the tanker, the end cross section as shown in FIG. 3 will generally be circular or slightly elliptical. Where a drop bottom tanker of the type shown in FIG. 1 is employed, the interior cross section as shown by FIG. 2, because of the greater vertical dimension of the tanker at this location, will be generally elliptical in configuration with the major axis being the vertical axis as shown.

The forward portion of the elongated tank 10 is equipped with a forward conveyor 28 which, in a symmetrical tank having the relationship shown in FIG. 1, normally will be identical to the aft conveyor system 30. The forward conveyor system 28 is disposed near the bottom portion 18 of the tank and comprises an axle 40 which supports an auger system 43, again preferably comprising inner and outer auger flights of opposed pitches and which is mounted on bearing stands 45 and 46. The forward prime mover 31, which may be identical to the prime mover 33, is disposed near the forward end of the tank 10 to drive the second conveyor 28.

As can been seen from an examination of FIG. 1 and also the sectional views of FIGS. 2 and 3, the conveyor systems transcend only a relatively minor cross-sectional portion of the tank 10. Preferably, as described in detail below, the outer auger flight transcends a cross-sectional area which is about ⅕ or less than the total cross-sectional area of the tank. Thus, the conveyor systems have a vertical dimension which is less, usually significantly less, than ½ of the vertical diameter.

Figure 4:
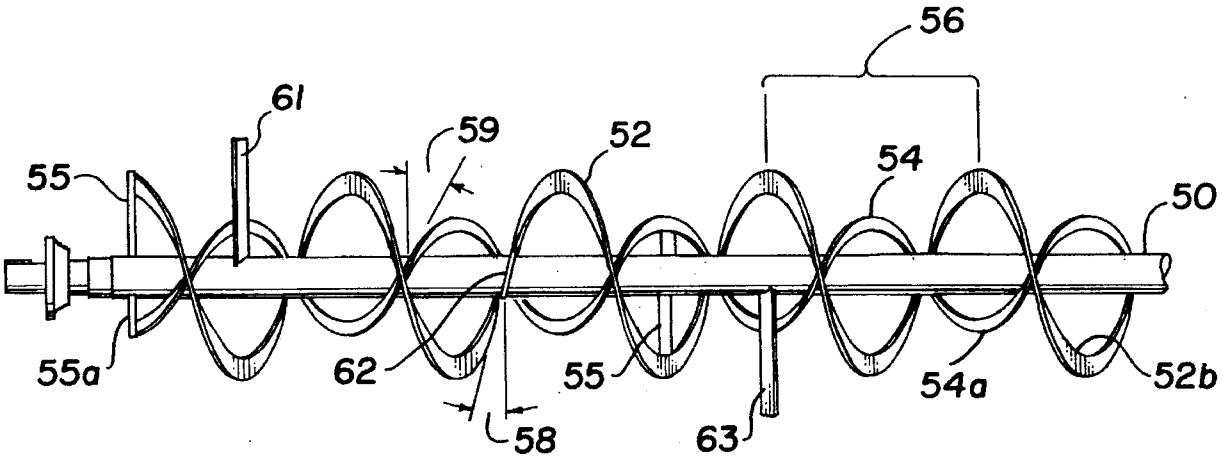
FIG. 4 is a side elevation showing a preferred form of conveyor system of the invention embodying inner and outer auger flights and angularly disposed paddles.

Turning now to FIG. 4, there is illustrated a preferred form of conveyor system embodying the present invention, comprising inner and outer auger flights and angularly disposed radial paddles, which are configured to work in conjunction with the outer auger flight in displacement of sludge material throughout the tank in the direction of the discharge port. In the preferred embodiment illustrated, the inner and outer auger flights are in the form of "ribbons" which are radially spaced from the axle on which they are supported. As shown in FIG. 4, the conveyor system comprises an axle 50 which supports an outer auger flight 52 and a smaller diameter inner auger flight 54. By way of example, the axle 50 may take the form of a 2½ solid shaft which supports the outer ribbon flight 52 having a diameter of 18" and an inner ribbon flight 54 having a diameter of 10". The ribbon flights may be secured to the axle by any suitable means which will typically incorporate longitudinally and angularly displaced spider arms 55 and **55*a* extending radially outwardly from the axle to support the auger flight. By way of example, the support for the ribbon flights might take the form of ¾" steel rods which extend from the solid axle and to which the ribbon flights are secured by any suitable means such as welding. The inner and outer ribbon flights preferably are configured so that the outer perimeter 58*a* of the inner auger flight ribbon 54 is less than the inner perimeter 52*b* of the outer auger flight 52**. Also, the width of the inner ribbon flight normally will be somewhat less than the width of the outer auger flight. Thus, in the specific embodiment described above with the relationship of a 10" inner auger flight and an 18" outer auger flight, the inner ribbon has a width of 2" and the outer ribbon a width of 3".

As shown in FIG. 4, the outer auger flight 52 is pitched in one direction and the inner auger flight 54 is pitched in the opposite direction. It has been found that this relationship between the inner and outer auger flights and provides a very effective system for retaining the particulate material in suspension within the carder liquid of the sludge near the bottom of the tank. At the same time, the reverse pitch configuration of the two auger flights allows this to be accomplished without the relatively high torque which would be required for more conventional agitation systems which often extend over half the vertical dimension of the tank. As shown in FIG. 4, the pitch slope of the inner auger flight 54 is greater than the pitch slope of the outer auger flight 52. In the embodiment illustrated, the pitch lengths, as indicated by bracket 56, of the two auger flights are the same. In the embodiment illustrated, in which the perimeter of the outer auger flight is 18" and the perimeter of the inner auger flight is 10", both can have pitch lengths of 18". This results in a pitch slope of the outer auger flight 52, as indicated by angle 58, of about 15° and a pitch slope of the inner auger flight, as indicated by angle 59, of about 22°. Other relative dimensions of the pitch lengths of the two auger flights can be employed in accordance with the present direction. Usually it will be preferred, in any case, to have the inner auger flight pitched more steeply or, stated otherwise, the ratio of the pitch length of the inner auger flight to the diameter of the inner auger flight will be greater than the pitch length of the outer auger flight to the diameter of the outer auger flight.

Figure 5:
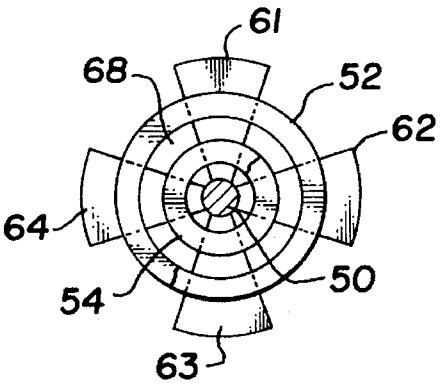
FIG. 5 is an end view of the conveyor system of FIG. 4.

As further illustrated in FIG. 4 and also in FIG. 5, the axle 50 is provided with radial paddles 61–64 which are disposed longitudinally along the axis and angularly displaced from one paddle to the next. As shown in the drawing, the paddles preferably are angularly displaced at angles of 90° along the shaft, thus providing four paddles throughout a 360° rotation of the shaft. However, fewer or, in rare cases, a greater number of paddles displacements can be provided, but normally at least two paddles will be provided throughout each 360° rotation around the shaft. While, not necessary since the paddles do not take up a major vertical dimension of the tank, it is nevertheless preferred that the paddles be balanced in their angular displacement. Where four paddles are provided as shown in FIG. 4, they are displaced in angles of 90°. If only three paddles were provided, they would be radially displaced from one paddle to the next at angles 120°. As shown in FIG. 4, the paddles 61–64 are pitched in the same direction as the outer auger flight 52. In the embodiment illustrated, the paddles are pitched at an angle of 15° from a radial plane normal to the axle 50.

Further details of the paddles are shown in FIG. 5 which is an end view of the conveyor of FIG. 4. The relative configurations of the inner and outer auger flights are shown in the end view of FIG. 5. As sown there, the outer diameter of the inner ribbon flight 54 stops short of the inner diameter of the outer auger flight 52 to provide, when viewed from the end of the conveyor, an annular clearance between the auger flights as indicated by reference numeral 68. As illustrated there, the paddles preferably diverge outwardly to provide an equilateral trapezoid with the larger end and being in the form of a convex segment at the end of the paddle. The paddles preferably extend somewhat beyond the outer perimeter of the outer auger flight 52. Thus, in the embodiment having the dimensions described previously with an 18" diameter outer auger flight, the paddles may extend 3" beyond the outer diameter for providing an effective diameter for the paddles of 2 feet, that is, with each paddle extending one foot from the centerline of the shaft. Various other configurations of the auger flights of the paddles can be employed in carrying out the present invention. For example, while it is preferred that the paddles extend beyond the outer perimeter of the outer auger flight, paddles having the same circumference or even a somewhat smaller circumference, can be employed. Also, while the inner and outer auger flights will normally have the same pitch lengths, resulting in a steeper pitch angle for the inner auger flight, this convention may not be observed in some embodiments of the invention. Normally, it will be preferred to provide that the outer auger flight have a pitch angle, as measured from a plain normal to the axis of the axle, within the range of 10°–20° with the inner auger flight within the range of 20–25°.

It can be seen that the present invention incorporates a number of important advances over prior art systems such as those involved in the aforementioned patents to Neier and Rumph. By configuring two auger flights to rotate concentrically about the same axis, this allows effective dispersion of the particulates within the liquid medium near the bottom of the tank where it counts, while at the same time effectively conveying the sludge suspension to a discharge port when it is desired to discharge the sludge from the vessel. This is accomplished with relatively low torque requirements as contrasted with the so-called blade systems such as involved in the Neier and Rumph systems and avoids the need for special lightweight materials or disposable or movable paddles to accommodate the high torque situations.

While a converging bottom tanker configuration of the type illustrated in FIG. 1 will usually be preferred, it is to be recognized that the invention can also incorporate tank containers having discharge ports at one end or at both ends of the tank. Normally the tank will have at least some inclined bottom surface to facilitate removal of sludge from the tank, but a conventional cylindrical tank car with a horizontal bottom surface can also be employed. In this case, two or more conveyor system of the type described above can be employed although in some cases only a single conveyor system powered by a motor either at one end or at the center of the tank can also be employed.

Figure 6:
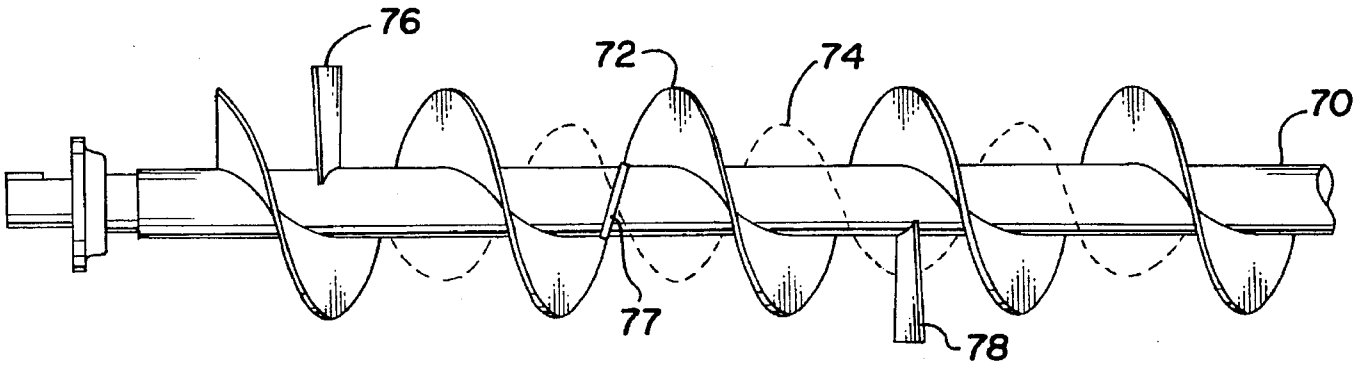
FIG. 6 is a side elevation showing a conveyor system of yet another embodiment of the invention.

In a further embodiment of the invention shown in FIG. 6, a solid screw type auger is employed. That is, rather than the auger system comprising a ribbon type arrangement such as shown in FIG. 4, the auger system incorporates a solid auger flight. This system, like the system described previously, is a compound system and comprises radial paddles as described above and incorporates both inner and outer auger flights having opposed pitches as described above.

Turning now to FIG. 6, there is illustrated an auger system comprising an axle 70 which supports an auger flight 72 and radial paddles 76–78 which are longitudinally and angularly displaced similarly as described above. Except for the fact that the auger flight is solid, the same parameters as described above with respect to parameters of pitch and paddle displacement are preferably employed in the embodiment of FIG. 6. The embodiment of FIG. 6, may or may not have an inner auger flight, indicated by broken line 74, having the same relationship to the outer auger flight as described above. Where a solid outer auger flight 72 is employed, the inner auger flight 74 must necessarily be discontinuous or, alternatively, the outer auger flight 74 may be provided with "slots" or "tunnels" (not shown) through which a solid continuous inner auger flight may pass. Although in the embodiments illustrated, the compound auger systems employ solid type or ribbon type auger flights, it is to be recognized that a hybrid system can also be employed in carrying out the invention. Thus, for example, the outer auger flight may be formed of a ribbon type auger as shown in FIG. 4 and the inner auger flight may be a solid type configuration of the type as shown in FIG. 6.

Either of the inner or auger flights, or both the inner and outer flights, can be discontinuous or segmented. This is especially so in the case of the inner auger flight since its primary function is to create a condition of turbulence near the bottom of the tank. The outer auger flight preferably will be continuous since its function is to convey sludge in the direction of a discharge port in addition to the creation of turbulence. In an embodiment of the invention in which the paddles are not present, or where the paddle radius is no greater than the radius of the outer auger flight, the conveyor system will be configured so that there is only some small clearance, normally about an inch or so between the outer perimeter of the outer auger flight and the bottom of the tank. Where paddles are present of a radial dimension greater than the outer perimeter of the outer auger flight as indicated in the embodiment shown in FIG. 4, the distance between the tip of the paddles and the bottom of the tank should meet this criteria, i.e. they should be configured so that they terminate about an inch from the bottom of the tank surface.

Having described specific embodiments of the present invention, it will be understood that modifications thereof may be suggested to those skilled in the art, and it is intended to cover all such modifications as fall within the scope of the appended claims.

What is claimed:

1. In a system for the disposition of sludge material, the combination comprising:

a. an elongated tank having a bottom portion extending longitudinally thereof and adapted to contain a sludge material comprising a mixture of solid particulates in a liquid medium;

b. an elongated conveyor system disposed longitudinally in said tank along the major axis of said tank near the bottom portion thereof and comprising an inner auger flight and an outer auger flight both disposed for concentric rotation about an axis extending longitudinally of said tank, said outer auger flight having a pitch slope in an opposed direction with respect to the pitch slope of said inner auger flight;

c. at least a portion of said tank having a bottom inclined surface oriented at an angle from the horizontal; and d. a withdrawal port located in the bottom of said tank at a lower portion of said inclined surface.

2. The combination of claim 1, further comprising an axle extending longitudinally of said tank and wherein said inner and outer auger flights are concentrically supported on said axle.

3. The combination of claim 2, wherein said outer auger flight comprises a ribbon flight spaced radially from said axle.

4. The combination of claim 3, wherein said inner auger flight has an outside diameter which is less than the inner diameter of the outer ribbon flight to define with the inner diameter of said outer ribbon flight an open annular clearance between the auger flights.

5. The combination of claim 3, wherein said inner auger flight comprises a ribbon spaced flight radially from said axle.

6. The combination of claim 3, wherein said inner auger flight is a solid auger flight.

7. The combination of claim 2, further comprising a plurality of paddles disposed longitudinally along said axle and extending radially from said axle at angularly displaced positions on said axle.

8. The combination of claim 7, wherein said paddles are oriented at a pitch in the same direction as the pitch of said outer auger flight.

9. The combination of claim 7, wherein said paddles are angularly displaced along said axle at orientations to provide at least two paddles for each 360° rotation.

10. The combination of claim 7, wherein said paddles are angularly displaced along said axle at orientations to provide at least three paddles for each 360° rotation.

11. The combination of claim 7, wherein said paddles are angularly displaced along said axle at orientations to provide at least four paddles for each 360° rotation.

12. The combination of claim 7, wherein said paddles extend radially outward from said axle beyond the perimeter of said outer auger flight.

13. The combination of claim 1, wherein said outer auger flight has a pitch angle within the range of 10°–20°.

14. The system of claim 1, further comprising means for rotating said outer auger flight in a direction to provide a positive pitch angle of said outer auger flight in the direction of said withdrawal port.

15. In a system for the disposition of a sludge material, the combination comprising:

a. an elongated tank having an intermediate drop portion and first and second bottom portions sloping toward said intermediate drop portion in a converging relationship;

b. a first elongated conveyor system disposed longitudinally in said tank near the first bottom portion of said tank and comprising a first inner auger flight and a first outer flight disposed for concentric rotation about an axis extending longitudinally of said tank, said first outer auger flight having a pitch slope in an opposed direction with respect to the pitch slope of said inner auger flight;

c. a second elongated conveyor system disposed longitudinally in said tank near the second bottom portion of said tank and comprising a second inner auger flight and a second outer flight disposed for concentric rotation about an axis extending longitudinally of said tank, said second outer auger flight having a pitch slope in an opposed direction with respect to the pitch slope of said inner auger flight;

d. a withdrawal port located in the drop portion of said tank; and e. means for rotating said first and second outer auger flights of said first and second conveyor systems in the direction of said withdrawal port.

16. The combination of claim 15, wherein said first elongated conveyor system further comprises a first axle extending longitudinally of said tank and said inner and outer auger flights of said first conveyor system are concentrically supported on said axle and wherein said second conveyor system comprises a second axle extending longitudinally of said tank and wherein said inner and outer auger flights of said second conveyor system are concentrically supported on said second axle.

17. The combination of claim 16, wherein said outer auger flights comprise ribbon flights spaced radially from said axles.

18. The combination of claim 17, wherein said inner auger flights comprise ribbon flights spaced radially from said axle.

19. The combination of claim 18, wherein said inner ribbon flights have outside diameters which are less than the inner diameters of the outer ribbon flights to define with the diameters of said outer ribbon flights open annular clearances between the auger flights.

20. The combination of claim 15, wherein the outer perimeters of said outer auger flights transcend an area of no more than ⅕ the cross sectional area of said tank.

21. The combination of claim 20, further comprising a plurality of paddles disposed longitudinally along said first and second axles and extending radially from said axles at angularly displaced positions on said axles.

22. The combination of claim 21, wherein the pitch angles of said inner auger flights are greater than the pitch angles of said outer auger flights.

23. The combination of claim 21, wherein said paddles on said first and second axles are pitched in the same direction as said first and second outer auger flights, respectively.

24. In a system for the transportation of sludge material, the combination comprising:

a. an elongated tank having an arcuate bottom portion extending longitudinally thereof and adapted to contain a sludge material comprising a mixture of solid particulates in a liquid medium;

b. a withdrawal port located in the arcuate bottom portion of said tank adapted for the withdrawal of sludge material from said tank; and c. an elongated conveyor system disposed in the lower half of said tank along the major axis of said tank near the bottom portion thereof and comprising an inner auger flight and an outer auger flight mounted in said tank for concentric rotation about an axis extending longitudinally of said tank, said outer auger flight having a pitch slope in an opposed direction with respect to the pitch slope of said inner auger flight and transcending a cross-sectional area which is no more than ⅕ the cross-sectional area of said tank.

25. The combination of claim 24, further comprising means for rotating said outer auger flight in a direction providing a positive pitch angle of said angle in the direction of said withdrawal port while concurrently rotating said inner auger flight to provide a negative pitch angle of said auger flight in the direction of said withdrawal port.

26. The combination of claim 25, wherein the pitch angle of said inner auger flight is greater than the pitch angle of said outer auger flight.

27. The combination of claim 24, further comprising an axle extending longitudinally of said tank wherein said inner and outer auger flights are concentrically supported on said axle and further comprising a plurality of paddles disposed longitudinally along said axle and extending radially from said axle at angularly displaced positions on said axle.

28. The combination of claim 27, wherein said paddles extend radially outward from said axle beyond the perimeter of said outer auger flight.

29. In a system for the transportation of sludge material, the combination comprising:

a. an elongated tank having an arcuate bottom portion extending longitudinally thereof and adapted to contain a sludge material comprising a mixture of solid particulates in a liquid medium;

b. a withdrawal port located in the arcuate bottom portion of said tank and adapted for the withdrawal of sludge material from said tank;

c. an elongated axle rotatably disposed in the lower portion of said tank along the major axis thereof;

d. a longitudinal auger flight supported on said axle for rotational movement with said axle; and e. a plurality of paddles disposed longitudinally along said axle and extending radially from said axle at angularly displaced positions on said axle; said paddles being angularly displaced along said angle at orientations to provide at least two radially disposed paddles for a pitch length of said auger flight.

30. The combination of claim 29, wherein said paddles are oriented at a pitch in the same direction as the pitch of said auger flight.

31. The combination of claim 30, wherein said paddles extend radially outward from said axle beyond the perimeter of said auger flight.

32. The combination of claim 29, wherein said paddles are angularly displaced along said axle at orientations to provided at least three paddles per pitch length of said auger flight.

33. The combination of claim 29, further comprising an inner longitudinal auger flight supported on said axle; said inner auger flight having a perimeter which is less than the perimeter of said first recited auger flight.

34. The combination of claim 33, wherein said inner auger flight has a pitch slope in an opposed direction with respect to the pitch slope of the first recited auger flight.

35. The combination of claim 34, wherein the pitch slope of said inner recited auger flight is greater than the pitch slope of said first recited auger flight.

36. In a system for the transportation of sludge material, the combination comprising:

a. an elongated tank having an arcuate bottom portion extending longitudinally thereof and adapted to contain a sludge material comprising a mixture of solid particulates in a liquid medium;

b. a withdrawal port located in the arcuate bottom portion of said tank and adapted for the withdrawal of sludge material from said tank;

c. an elongated axle extending along the major axis of said tank and disposed in the lower half of said tank;

d. an outer auger flight supported on said axle and comprising a ribbon flight having an inner and outer diameter extending longitudinally along said axle and wrapped around said axle in a manner in which the inner diameter of said ribbon flight is spaced radially from said axle; and e. an inner auger flight supported on and extending longitudinally of said axle, said inner auger flight having an outer diameter which is less than the inner diameter of said outer ribbon flight to define with the inner diameter of said outer ribbon flight an open annular clearance between said outer flights.

37. The combination of claim 36, wherein said inner auger flight comprises a ribbon flight having an inner diameter which is spaced radially from said axle.

38. The combination of claim 36, wherein said inner auger flight is a solid auger flight.

39. The combination of claim 36, further comprising a plurality of paddles disposed longitudinally along said axle and extending radially from said axle at angularly displaced positions on said axle.

40. The combination of claim 39, wherein said paddles extend radially outward from said axle beyond the perimeter of said outer auger flight.

41. The combination of claim 40, wherein said paddles are oriented at a pitch in the same direction as the pitch of the outer auger flight.

* * * * *